United States Patent [19]

Prough

[11] 4,146,422

[45] Mar. 27, 1979

[54] METHOD FOR OBTAINING ANY VARIATION IN THE FIBER CONTENT OF A DIGESTER EFFLUENT SLURRY

[75] Inventor: James R. Prough, Glens Falls, N.Y.

[73] Assignee: Kamyr Inc., Glens Falls, N.Y.

[21] Appl. No.: 815,200

[22] Filed: Jul. 12, 1977

Related U.S. Application Data

[63] Continuation of Ser. No. 717,390, Aug. 24, 1976, abandoned, which is a continuation of Ser. No. 526,064, Nov. 21, 1974, abandoned, which is a continuation of Ser. No. 320,827, Jan. 3, 1973, abandoned.

[51] Int. Cl.[2] ..... D21C 3/24; D21C 7/12

[52] U.S. Cl. ..... 162/49; 73/32 R; 162/238; 162/DIG. 10; 250/358 R; 250/573

[58] Field of Search ..... 162/49, 238, 61, 62, 162/DIG. 6, DIG. 10, 17; 250/356, 358 R, 573, 358 P; 73/32 R, 63

[56] References Cited

U.S. PATENT DOCUMENTS

| | | | |
|---|---|---|---|
| 3,058,672 | 10/1962 | Zabel | 73/63 |
| 3,322,616 | 5/1967 | Hutchinson et al. | 162/61 |
| 3,764,463 | 10/1973 | Histed et al. | 162/238 X |

OTHER PUBLICATIONS

"Changes in Kraft Continuous Digester Instrumentation", Morrison, *Paper Trade Journal,* Sep. 14, 1964, pp. 47–51.

"Review of Process Control", Holm et al. *TAPPI,* vol. 53, No. 9, pp. 1638–1649.

"Nuclear Process Control Experience in the Paper Industry", Doering Proc. Nuclear Applns., ICBIB, Series 241, Abstract #78.

"Pulp Plant to Get Closed Loop Computer Control", *Chem. Eng.,* Jun. 10, 1963, pp. 90–92.

"Automatic Control of a Kraft Continuous Digester", Boozer et al., *Paper Trade Journal,* vol. 11, 1962, pp. 42–46.

"Computer Controlled Pulping Details Given", *Chem. & Eng. News,* Nov. 11, 1963, pp. 46–47.

"Control, Secondary Fiber, Structural Board Coating", p. 270 (1969), Pulp & Paper Manufacture, Second Edition, vol. II, McGraw Hill.

"Computer Applications: Woodlands Through Bleach Plant–II", Grant, *Paper Trade Journal,* Jun. 21, 1971, pp. 36–41.

*Primary Examiner*—S. Leon Bashore
*Assistant Examiner*—Steve Alvo
*Attorney, Agent, or Firm*—Cushman, Darby & Cushman

[57] ABSTRACT

An improved process for continuously monitoring and controlling a continuous process for digestion of cellulose utilizing a computer which is programmed to determined (1) the mass of wood being fed to the digester from measurements of the density of the wood slurry feed, the density of the liquid and the total flow of slurry, (2) the mass of wood being withdrawn from the digester from measurements of the density of the pulp slurry, the density of the liquor and the total flow of slurry, (3) the correct amount of fresh digester liquor to be added concurrently with the wood feed and (4) amount of water wash and makeup digester liquor to be fed to the reactor. The computer can also be programmed to control the temperature in the reaction zone of the digester.

2 Claims, 1 Drawing Figure

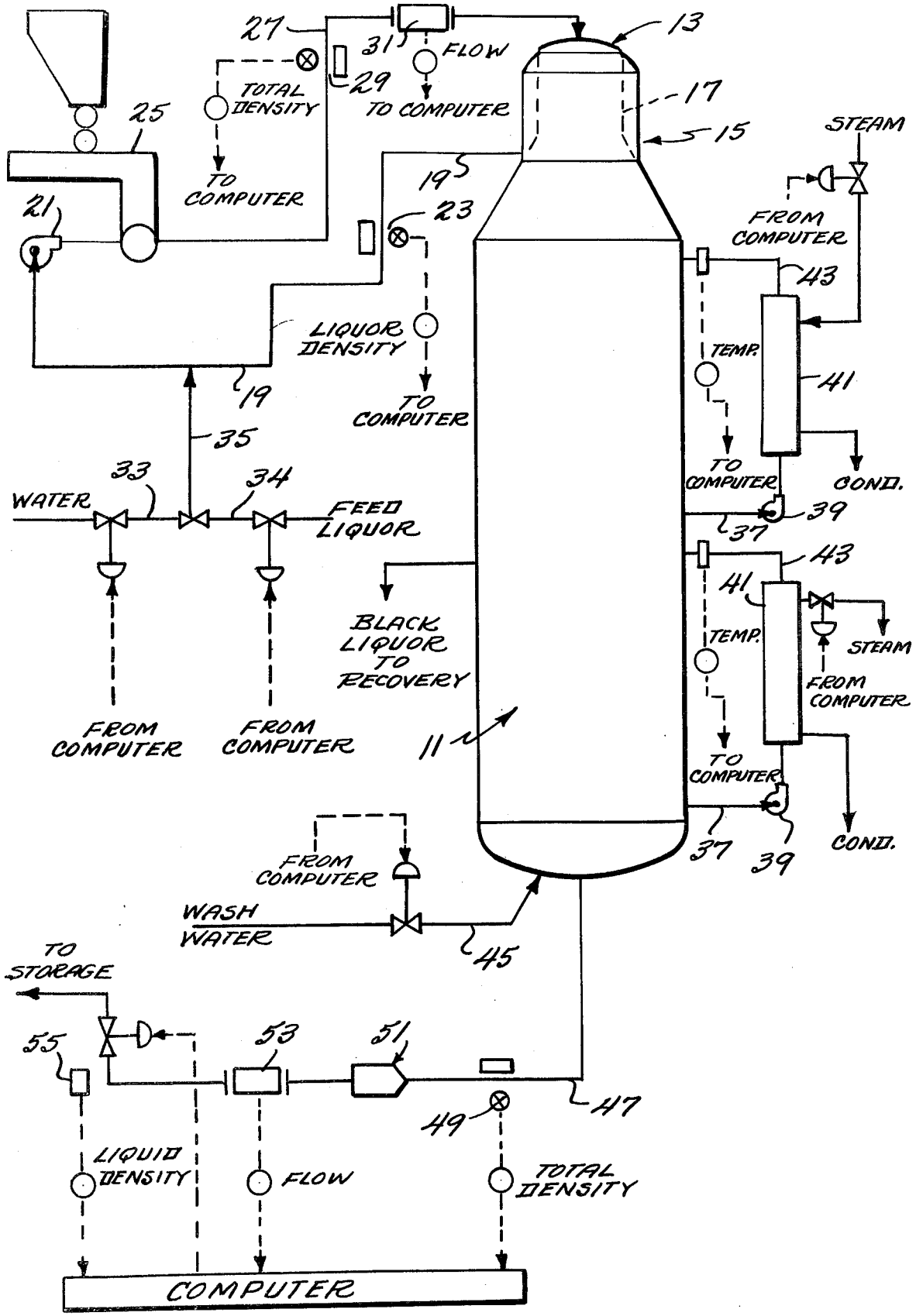
27
31
FLOW
13
29
TOTAL DENSITY
TO COMPUTER
17
25
15
STEAM
TO COMPUTER
19
21
23
FROM COMPUTER
43
LIQUOR DENSITY
TEMP.
41
19
TO COMPUTER
35
TO COMPUTER
COND.
33
34
WATER
FEED LIQUOR
39
37
43
41
BLACK LIQUOR TO RECOVERY
TEMP.
STEAM
FROM COMPUTER
FROM COMPUTER
FROM COMPUTER
11
TO COMPUTER
FROM COMPUTER
37
39
COND.
WASH WATER
45
TO STORAGE
55
53
51
47
49
LIQUID DENSITY
FLOW
TOTAL DENSITY
COMPUTER

METHOD FOR OBTAINING ANY VARIATION IN THE FIBER CONTENT OF A DIGESTER EFFLUENT SLURRY

This application is a continuation of application Ser. No. 717,390 filed Aug. 24, 1976, now abandoned which in turn is a continuation of Ser. No. 526,064, filed Nov. 21, 1974, now abandoned which in turn is a continuation of Ser. No. 320,827, filed Jan. 3, 1973, now abandoned.

This invention relates generally to a novel process and apparatus for controlling essential variables in a continuous process for digestion of cellulose such as described in U.S. Pat. Nos. 3,041,232 and 3,200,032.

With the development of continuous cellulose digesters there is a real need for adequate process control in order to insure uniformity of the resulting product. The digestion involves an exothermic reaction and it will be recognized that the digestion temperature will vary depending on, for example, the amount of wood chips and digesting chemicals supplied to the digester, the digestion time and like factors. Significant variations in these and other operating conditions can result in a non-uniform digester product, which causes all sorts of other process complications and a general breakdown of quality control. Batch digestion does not suffer from this problem because the quality of the product is pretty well determined by the conditions, initially selected. However, in continuous cellulose digestion systems, careful watch and control of process conditions must be observed in order to avoid substantial difference in product quality and characteristics.

Essential variables in the continuous digestion of cellulose include the feed of essential materials, namely cellulose (e.g. wood chips,) water and digesting liquor; temperature in the digester and mass of digested solids withdrawn from the digester. According to the invention, it is proposed to provide unique means for monitoring these variables and suitably compensating as necessary to control the digestion process and maintain product uniformity.

Thus, in one embodiment of the present invention, the total mass of pulp slurry flowing from the digester is continuously monitored by a gamma absorption device and by a flow measurement. Additionally, the total mass of liquid in the digester effluent is continuously measured by a refractometer. The gamma absorption device determines the density of the pulp slurry by measuring the amount of gamma particles absorbed by the slurry. The refractometer determines the density of the liquid portion of the slurry along with the total mass measurement by measuring the refractive index of the liquor. These measurements may be continuously fed to a computer which in turn is programmed to adjust the amount of wood chips, water and digesting liquor fed to the digester as necessary to maintain the desired solids content in the digester product.

The success of the invention is due, at least in large part, to the findings that meaningful process control can be realized by the indicated density measurements on the pulp discharged from the digester. This is surprising for several reasons. Thus, for example, while the use of a gamma absorption device to measure densities of primary liquids and slurries, where the components have substantially different densities, is known, the solids and liquid making up the digester pulp discharged from the digester have quite similar densities, and the use of gamma absorption means for measuring density in such circumstances has been thought unreliable. (Kirk-Othmer, Encyclopedia of Chemical Technology, Second Edition, Vol. 6, page 773).

It is also surprising that a refractometer can be used as proposed herein in determining density of the liquid portion of a slurry without first separating the solid therefrom since the refractometer is conventionally used only where liquids alone are involved.

The combination of gamma absorption device, refractometer and flow measurement device nicely serves to differentiate the composition of the slurry or effluent from the digester, and thus is extremely beneficial towards automatic control of the digester operation. Quite unexpectedly, the gamma absorption device and refractometer give reliable and accurate measurements of the density of a pulp slurry and the liquid portion of the slurry, respectively, even though the densities of the solid and liquid involved are not greatly different and the solids are not separated from the liquid in the slurry prior to measurement with the refractometer.

In the prior art, the practice has been to separate the pulp from the digester liquor and then measure the density of the dried pulp and that of the liquor in separate operations. As will be appreciated, the present invention involves a novel method of obtaining instantaneous and continuous measurement of pulp density while the pulp slurry is still in the process equipment and the pulp solids are mixed with the digesting liquor.

In a further modification of the invention, a gamma absorption device may be used to accurately monitor the amount of wood chips fed to the digester. One of the principal sources of process variation in the digester is the non-uniformity of wood chip loading. The chip meters used to feed the chip to the digester are usually volume type meters wherein a controlled volume of chips is obtained. The accurate measurement of chip volume allows the control of residence time or cooking time in the digester (that is if the effluent from the digester is controlled effectively). However, due to non-uniformity of the chip composition, such as size distribution of chip particles and porosity of the chip, the volumetric control does not produce a uniform mass of chips entering the digester. The modification proposed herein permits continuous measurement of the mass of the wood which is fed to the digester and thus offers a closer control on the digestion than hitherto possible. Briefly stated, the measurement of wood chips fed to the digester is correlated with the amount of digesting liquor fed to the digester so that the amount of liquor is controlled and adjusted as necessary to accommodate for any variation in the amount of wood chips fed to the digester.

The accurate monitoring of wood chips fed to the digester according to the invention, is accomplished by measuring the difference in density of the liquor flow feeding the chip to the digester before and after the chips have been introduced therein. As described in U.S. Pat. No. 3,041,232, the chip is characteristically charged first into a feed conduit and carried by liquor which is circulating therein into the digester. The digester liquor is then separated from the fiber material and the liquor returned to the circulation conduit. The density of the liquor is measured, according to this invention, by a gamma absorption device just prior to when the chips are introduced therein and again just after the chips have been introduced. The resulting density measurements may then be fed, along with a total flow measurement, to a computer which is programmed to modify the amount of fresh digester liquor fed to the system based on the amount of wood chips determined by the density and flow measurements. Here again, the excellent control of wood and fresh digester liquor resulting from the use of a means including a gamma adsorption device is quite unexpected, as it could not have been predicted that there could be a significant and meaningful density variation between the digester liquor without chips and the digester liquor containing the wood chips to give an indication of amount of wood chips supplied in unit time.

An especially preferred embodiment of the present invention is obtained by combining the use of the gamma absorption device on both the wood feed to the digester and the pulp effluent from the digester in combination with flow measurements in each line and also a refractometer on the effluent from the digester. All these measurements may be fed to a computer which in turn provides for the correct amount of fresh digester liquor to be fed to the digester, the correct temperature to be maintained in the digester and correct flow rate of effluent from digester.

The invention is more fully explained with reference to the accompanying drawing which diagrammatically illustrates a preferred embodiment of the digesting system and process according to the invention.

Referring to the drawing, the numeral 11 designates an upright cylindrical digester. At its upper end, the digester 11 is provided with appropriate charging or inlet means 13 of a type well known in the art, for example, as shown in U.S. Pat. Nos. 2,459,180 and 3,041,232.

A sieve housing 15 is attached to the upper end of the digester. Inside the sieve housing 15 is located a sieve 17 which separates the wood chips from the return liquor, the return liquor being withdrawn through line 19 and fed to the intake of pump 21. A gamma absorption device 23 is situated along line 19 between the digester and the pump. This device measures the density of the liquor being withdrawn from the digester and sends this information to a computer.

The recycle liquor is cycled from pump 21 through a wood chip feeding device 25. Such a device is described in U.S. Pat. No. 3,041,232, the entire contents of which are incorporated by reference. The recycle liquor and suspended wood chips are then fed by line 27 to the digester 11. A gamma absorption device 29 and a flow meter 31 are situated in line 27 between the chip feeding device and the digester 11. The gamma absorption device measures the density of the wood chip-recycle liquor slurry, and the flow meter the total flow in the line. These measurements are also sent to the computer.

A water line 33 and a fresh liquor (lye) line 34 are connected together to form line 35 which feeds water and fresh liquor to line 19 on the intake side of pump 21. The amount of water and lye fed is controlled by automatic valves which are operated by an output signal from the computer.

In the drawing there is illustrated a digester having two digesting zones as is more fully described in U.S. Pat. No. 3,200,032, the entire contents of which are incorporated herein by reference. Digesting liquor is withdrawn from each zone by lines and fed to the intake of pump 39. The liquor is then pumped through heaters 41 in which steam is used to indirectly heat the liquor. The liquor is then cycled back to the digester in lines 43. The temperature of the recycled liquor is measured and sent to the computer. The amount of steam fed to heaters 41 is controlled by automatic valves which are operated by an output signal from the computer.

Near the bottom of the digester 11, wash waters is introduced through line 45 and the flow is controlled by an automatic valve which is operated by an output signal from the computer. At the bottom of the column, an effluent of pulp slurried in water is removed through line 47. This is commonly termed the "blow line" and the effluent is commonly called the "blow". In the blow line 47 there is situated a gamma absorption device 49 just upstream from the blow valve 51. The blow valve 51 reduces the pressure from about 250 psig to about 60 psig. Where the blow line temperature is high, it has been found that the gamma absorption device must be placed upstream from the blow valve 51 to obtain a reliable measure of the density of the pulp slurry. As the pulp passes through the blow valve 51, a substantial change in temperature occurs, and it has been found that at the higher temperatures, the measurement of pulp slurry density is not meaningful or useful.

After passing through the blow valve 51, the pulp slurry passes through a flow measuring device 53, such as a magnetic flow meter. The pulp slurry then passes through a refractometer 55 which measures the density of the liquor portion of the slurry. It has been unexpectedly found that the refractometer will give reliable, meaningful measurements of the density of the liquid portion of the pulp slurry if the measuring surface of the refractometer is kept wetted or provided with a thin liquid film. The pulp slurry is ultimately sent to storage.

In operation, the volume of wood chips is set by the chip feeder mechanism 25 so as to give a pre-set residence time in the digester. The actual mass of wood being charged is continuously determined by the computer from measurements of the recycle liquor flow, and density prior to the chip feeder and after the chip feeder. Again, as mentioned hereinbefore, it has been quite unexpectedly found that the density difference between the recycled liquor and then recycled liquor containing wood chips can be used to accurately and reliably determine the ratio of liquor to wood chip in the feed stream to the digester. The computer is programmed so as to control the amount of fresh liquor fed to the digester.

The flow of effluent or blow from the digester is controlled by the computer from the density measurement of pulp slurry in the blow line made by the gamma absorption device, the density measurement of the liquor contained in the pulp slurry made by the refractometer and total flow of slurry in the blow line made by the flow meter. The computer is programmed to control the effluent such that a total mass balance on wood or pulp is maintained. Again, as mentioned hereinbefore, it has been quite unexpectedly found that density measurements of the total pulp slurry and density measurements of the liquor portion of the pulp slurry can be used to reliably and accurately determine the mass of wood pulp in the slurry.

The computer is also programmed to control the wash water fed to the bottom of the digester and make-up water fed to the recycle liquor flow by a mass balance on water. The computer is also programmed to control the correct temperatures in the digester by heating the recirculating flows of liquor to a controlled temperature. The computer determines the correct temperature by using the data maintained earlier to determine, from well known empirical relationships known in the art, the optimum temperature in the digester.

It will be appreciated that the above example of this invention is merely for illustrative purposes thereof. The invention is not limited to particular temperatures and pressures to be employed in the digester or circulation conduits. Generally speaking, the apparatus and method of this invention may be carried out under conditions of temperature and pressure as conventionally used in the art of cellulose digestion and no special requirements therefor are imposed on the process by our novel process and apparatus. Of course, the pressure in the digester will be determined by the temperature employed. The temperature to which the circulating liquor is heated in heaters 41 may also be varied as desired within the skill of the art. One suitable temperature is 170° C., although, obviously, higher or lower temperatures than the 170° C. mentioned above, may be used if desired, particularly where a digester temperature about 170° C. is contemplated. It is also apparent that different supply lines for the starting materials can be used equally well, the figures mentioned above being desirable for optimum production and convenience of operation.

Equally well, the above-described specific embodiment of the apparatus may also be modified in other respects. For instance, a charging valve device of some other design may be used, such as a piston or screw feeding device. In addition, if desired, the sieve housing 15 at the upper end of the digester may be modified by placing the sieve 17 and a coaxial feeding screw in a horizontal or inclined position. The digester can be of conventional design using a one step or two step process. The device for removing the pulp slurry from the bottom of the digester can be of conventional design, e.g., the device described in U.S. Pat. No. 2,960,161.

The present invention will thus be seen to completely and effectively accomplish the purpose of this invention as enumerated hereinabove. It will be realized, however, that various changes and substitutions may be made to the specific embodiments disclosed herein for the purpose of illustrating the principles of this invention, without departing from these principles. Therefore, this invention includes all modifications encompassed within the spirit and scope of the following claims.

What is claimed is:

1. A method for obtaining an indication of the variation in the fiber content in the effluent slurry of a continuous pulp digester continuously in relation to time which comprises the steps of continuously measuring the gamma radiation absorption of the effluent slurry so as to derive continuous measurements which are a function of any variations in the combined densities of the fiber portion and liquid portion of the effluent slurry resulting from (1) variations in the fiber content in the effluent slurry alone, or (2) variations in the density of the liquid portion thereof alone or (3) variations in both (1) and (2);

continuously measuring the refractory index of the liquid portion of the effluent slurry while in slurry form so as to derive continuous measurements which are a function of any variation in the density of the liquid portion of the effluent slurry;

continuously measuring the volumetric flow rate of the effluent slurry; and utilizing the continuous refractory index measurements to compensate for variations in the continuous gamma radiation absorption measurements resulting from variations in the density of the liquid portion of the effluent slurry to thereby obtain a continuous indication of any variation in the fiber content of the effluent slurry.

2. A method for maintaining uniformity of fiber content in the effluent slurry of a continuous pulp digester which comprises the steps of continuously measuring the gamma radiation absorption of the effluent slurry so as to derive continuous measurements which are a function of any variations in the combined densities of the fiber portion and liquid portion of the effluent slurry resulting from (1) variations in the fiber content in the effluent slurry alone, or (2) variations in the density of the liquid portion thereof alone, or (3) variations in both (1) and (2);

continuously measuring the refractory index of the liquid portion of the effluent slurry while in slurry form so as to derive continuous measurements which are a function of any variation in the density of the liquid portion of the effluent slurry;

continously measuring the volumetric flow rate of the effluent slurry;

utilizing the continuous refractory index measurements to compensate for variations in the continuous gamma radiation absorption measurements resulting from variations in the density of the liquid portion of the effluent slurry to thereby obtain an indication of any variation in the fiber content of the effluent slurry continuously in relation to time; and utilizing the continuous indication of any variation in the fiber content of the effluent slurry to change the fiber content of the effluent slurry in a manner tending to make the fiber content of the effluent slurry uniform.

* * * * *